US008881692B2

(12) United States Patent
Yuasa

(10) Patent No.: US 8,881,692 B2
(45) Date of Patent: Nov. 11, 2014

(54) COOLING SYSTEM IN AIR-COOLED COMBUSTION ENGINE

(75) Inventor: Tsuneyoshi Yuasa, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 340 days.

(21) Appl. No.: 13/281,177

(22) Filed: Oct. 25, 2011

(65) Prior Publication Data

US 2012/0124842 A1 May 24, 2012

(30) Foreign Application Priority Data

Nov. 22, 2010 (JP) ..... 2010-260025

(51) Int. Cl.

| | |
|---|---|
| ***F01P 9/00*** | (2006.01) |
| ***F02B 75/18*** | (2006.01) |
| ***F02F 1/34*** | (2006.01) |
| ***F01P 1/02*** | (2006.01) |

(52) U.S. Cl.

CPC ..... *F01P 1/02* (2013.01); *F01P 2001/026* (2013.01)

USPC ..... 123/41.01; 123/41.85

(58) Field of Classification Search

USPC ..... 123/41.01–41.85

See application file for complete search history.

(56) References Cited

U.S. PATENT DOCUMENTS

| | | | | |
|---|---|---|---|---|
| 2,855,911 | A * | 10/1958 | Christiansen | 123/41.65 |
| 4,494,490 | A | 1/1985 | Kiyooka et al. | |
| 4,517,939 | A | 5/1985 | Kiyooka | |
| 4,744,337 | A | 5/1988 | Ebinuma et al. | |
| 5,543,716 | A * | 8/1996 | Miyata et al. | 324/402 |
| 6,067,951 | A * | 5/2000 | Kitajima | 123/196 R |
| 2002/0104493 | A1 * | 8/2002 | Fukuoka et al. | 123/73 PP |
| 2008/0223349 | A1 * | 9/2008 | Uenomaya et al. | 123/65 V |

FOREIGN PATENT DOCUMENTS

| | | |
|---|---|---|
| JP | 60-32523 | 3/1985 |
| JP | 62-71330 | 5/1987 |
| JP | 08-326553 | 12/1996 |
| JP | 3729667 | 5/2000 |
| WO | 99/45248 | 9/1999 |

OTHER PUBLICATIONS

Japanese Application No. 2010-260025 Office Action dated Mar. 4, 2014, 4 pages with English translation.

Chinese Application No. 201110366463.6 Office Action dated Dec. 4, 2013, 7 pages with partial English translation.

* cited by examiner

*Primary Examiner* — Lindsay Low
*Assistant Examiner* — Charles Brauch

(57) ABSTRACT

A top plate is provided in a top portion of a cylinder block of a combustion engine of a type, provided with a cooling fan, so as to lie perpendicular to a longitudinal axis of an engine cylinder. An intake side gasket interposed between the cylinder block and an intake unit is extended upwardly to contact the top plate to thereby seal a gap between the top plate and the intake side gasket. An exhaust side gasket interposed between the cylinder block and an exhaust unit is extended upwardly to contact the top plate to thereby seal a gap between the top plate and the exhaust side gasket. A cooling passage for passing therethrough a cooling air from the cooling fan is formed by the cylinder block, the top plate, the intake side gasket and the exhaust side gasket.

5 Claims, 5 Drawing Sheets

COOLING SYSTEM IN AIR-COOLED COMBUSTION ENGINE

CROSS REFERENCE TO THE RELATED APPLICATION

This application is based on and claims Convention priority to Japanese patent application No. 2010-260025, filed Nov. 22, 2010, the entire disclosure of which is herein incorporated by reference as a part of this application.

BACKGROUND OF THE INVENTION

1. Field of the Invention

The present invention relates to a cooling system in a small size air-cooled two-stroke cycle combustion engine for driving mainly a work machine such as, for example, a brush cutter.

2. Description of Related Art

An air cooled combustion engine such as, for example, a small size two-stroke cycle combustion engine generally makes use of a cooling fan, and a stream of cooling air induced by the cooling fan is introduced through a cooling passage, comprised of a fan covering and a cylinder covering (shroud) for covering side and top of an engine cylinder, to the engine cylinder so as to cool the engine cylinder. The cooling air then drawing heat from the engine cylinder is subsequently discharged to the atmosphere through the cylinder covering. In order to increase the cooling efficiency, the Japanese Patent No. 3729667 suggests the two-stroke cycle combustion engine of a type in which a metallic wind-blocking plate is fitted to a top surface of the engine cylinder and a baffle made of a resinous material and formed integrally so as to protrude downwardly from the cylinder covering so that the stream of cooling air can be efficiently guided towards the cylinder.

It has, however, been found that the above mentioned patent requires a gap or space to be defined between the resinous baffle and the metallic wind-blocking plate in order to prevent the elevated temperature of the cylinder from being transmitted to the resinous baffle and, therefore, the cooling air is apt to leak outwardly through this gap or space, accompanied by reduction in cooling effect.

SUMMARY OF THE INVENTION

In view of the foregoing, the present invention has been devised to substantially eliminate the problems and inconveniences inherent in the prior art two-stroke cycle combustion engine of the type referred to and is intended to provide a cooling system for the air cooled combustion engine, which makes an effective utilization of the cooling air to thereby increase the cooling efficiency.

In order to accomplish the foregoing object, the present invention provides a cooling system for an air cooled combustion engine, which includes a top plate provided in a cylinder block top portion of the combustion engine, provided with a cooling fan, so as to lie perpendicular to a longitudinal axis of an engine cylinder; an intake side gasket interposed between the cylinder block and an intake unit and extended upwardly to contact the top plate to thereby seal a gap between the top plate and the intake side gasket; an exhaust side gasket interposed between the cylinder block and an exhaust unit and extended upwardly to contact the top plate to thereby seal a gap between the top plate and the exhaust side gasket; and a cooling passage for passing therethrough a cooling air from the cooling fan, the cooling passage being formed by the cylinder block, the top plate, the intake side gasket and the exhaust side gasket.

According to this cooling system, the top plate, the intake side gasket and the exhaust side gasket cooperate with each other to define an outer wall of the cooling passage through which a stream of cooling air induced by the cooling fan flows, and the gap between the top plate and the intake side gasket and the gap between the top plate and the exhaust side gasket are sealed. Accordingly, there is no likelihood that the cooling air flowing within the cooling passage may leak. As a result thereof, the cooling air is effectively utilized to increase the efficiency of cooling the air cooled combustion engine. Since each of the intake side and exhaust side gaskets generally has a heat resistance, there should be no problem even if they contact with the top plate then heated to a high temperature.

The top plate referred to above is preferably prepared from a metallic plate member, in which case the top plate is fastened to the cylinder block by means of fastening members. According to this structural feature, since the top plate is formed by bending a metallic plate member and is then secured to the cylinder block by means of the fastening member, the structure can be simplified. Also, if the top plate is made to have a function as a heat sink at the time the combustion engine is halted, an insulator can have a reduced thickness and, to consequently, the weight of the combustion engine as a whole can be reduced advantageously.

In a preferred embodiment of the present invention, the top plate may have an end edge facing the cooling fan and may be formed with a guide section so as to extend diagonally downwardly from the end edge of the top plate for guiding the cooling air towards the cooling passage. According to this structural feature, the cooling air can be smoothly guided by and along the guide section and, therefore, the cooling effect can be further increased.

In another preferred embodiment of the present invention, the top plate may be formed with a guide groove for an ignition cable used to connect between an ignition plug and an ignition coil unit. According to this structural feature, positioning of that portion of the ignition cable within the guide groove permits the position of the ignition cable to be stabilized. Moreover, since that portion of the ignition cable is bent at a small bending angle at a location outwardly of the end edge of the top plate, an undesirable frictional wear of the outer surface of the ignition cable, which would be brought about by its contact with the end edge of the top plate, can be suppressed. Also, particularly where the top plate is prepared from the metallic plate member, such a contact of the ignition cable with the top plate can advantageously suppress the noise generating level of the ignition cable.

In a further preferred embodiment of the present invention, each of the intake side gasket and the exhaust side gasket may be extended downwardly so as to contact a cylinder gasket, interposed between the cylinder block and a crankcase, to thereby seal a gap between the intake side gasket and the cylinder gasket and a gap between the exhaust side gasket and the cylinder gasket. According to this structural feature, covering the lower portion of the cooling passage in a lower region of the cylinder block with the cylinder gasket is effective to form the cooling passage completely covering opposite end portions of the cylinder block, resulting in a further increase of the cooling efficiency.

Even any combination of at least two structural features disclosed in this specification, inclusive of the claims and the accompanying drawings, should be construed as included within the scope of the present invention. In particular, any combination of two or more of the appended claims should be construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, a preferred embodiment of the present invention will be described in detail with reference to the accompanying drawings.

Figure 1:
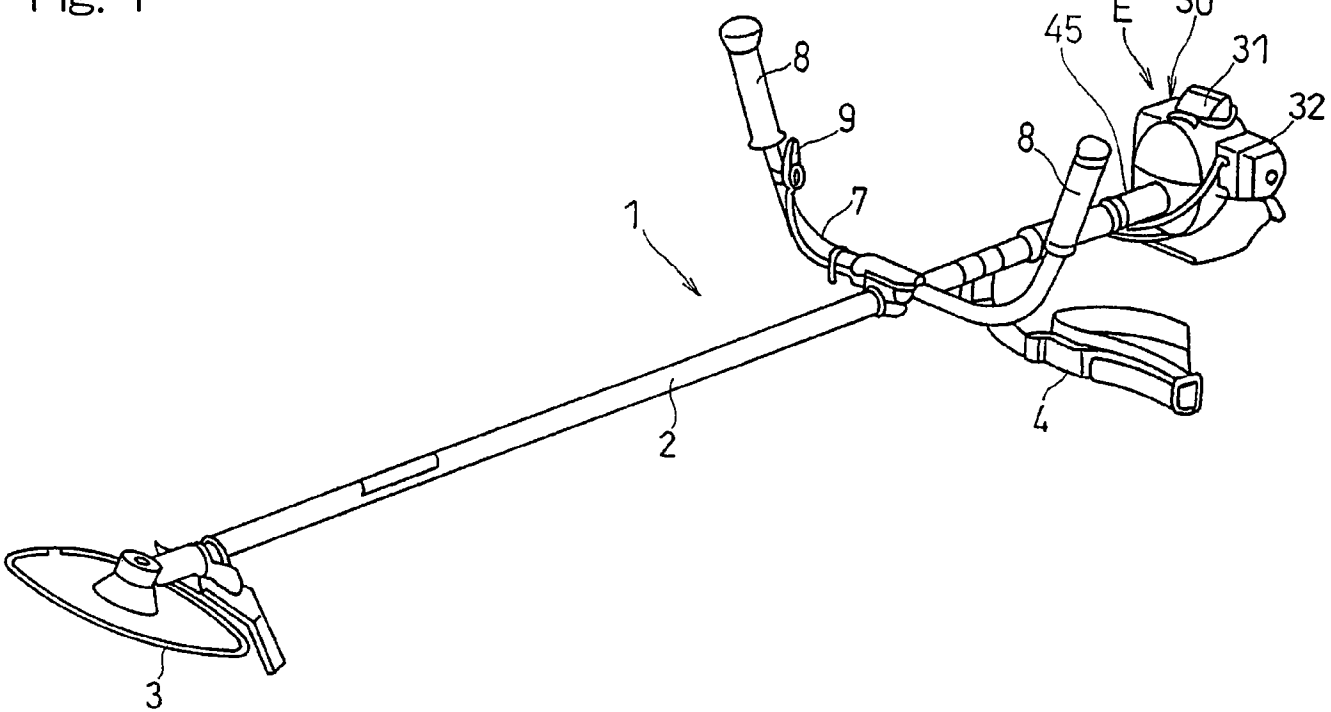
FIG. 1 is a perspective view showing a brush cutter utilizing an air cooled combustion engine provided with a cooling system according to a preferred embodiment of the present invention.

FIG. 1 illustrates a brush cutter 1, which is one of portable work machines utilizing a small size combustion engine E designed in accordance with the preferred embodiment of the present invention. The illustrated brush cutter 1 includes an elongated main pipe 2, made of an aluminum alloy which is an electroconductive metal, with the combustion engine E mounted on a proximal or rear end portion of such main pipe 2 and a rotary cutter blade 3 provided at a distal or front end thereof as a work tool. A drive shaft (not shown) rotatably extends through the hollow of the main pipe 2 and has a proximal end drivingly coupled with the combustion engine E and a distal end drivingly coupled with the cutter blade 3.

The main pipe 2 has a shoulder strap 4 and a generally U-shaped handlebar 7, both positioned on a portion of the main pipe 2 adjacent the combustion engine E, and the handlebar 7 has grips 8 mounted on opposite ends thereof. A worker carries the brush cutter 1 with the shoulder strap 4 hung on his shoulder and, also, with his hands holding the grips 8 on the opposite ends of the handlebar 7. In this condition, the worker starts the combustion engine E in any known manner to allow the cutter blade 3 to cut, for example, hogweeds. The number of revolution of the rotary cutter blade 3 can be adjusted by manipulating a throttle lever 9 mounted on a portion of the handlebar 7 adjacent one of the grips 8.

In any event, the brush cutter 1 or a similar work machine itself, to which the present invention is applied, may be of any known construction.

Figure 2:
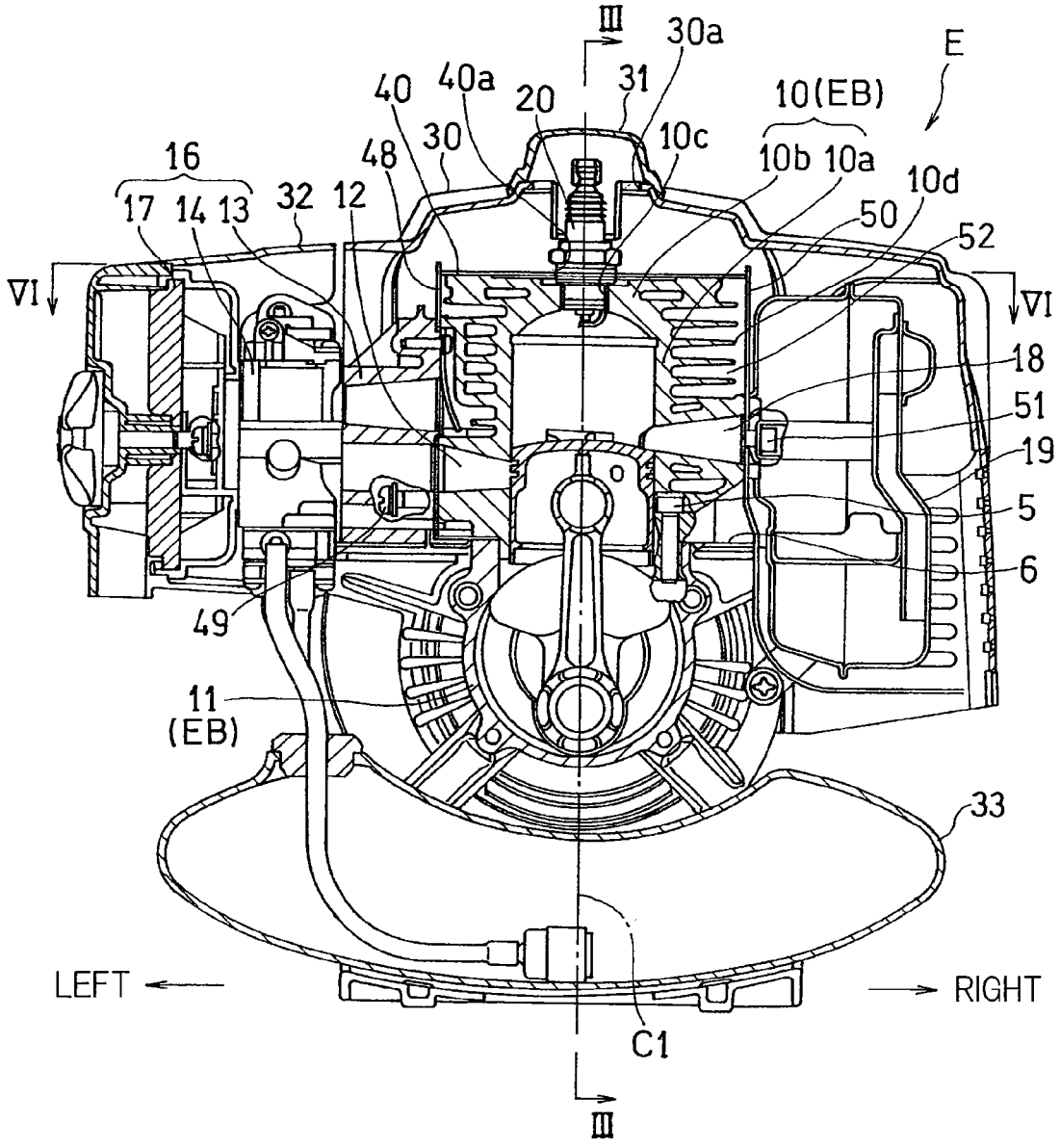
FIG. 2 is a rear sectional view showing the air cooled combustion engine.

FIG. 2 shows a fragmentary sectional view of the combustion engine E as viewed in a direction opposite to the main pipe 2. The combustion engine E is a two-stroke cycle combustion engine and includes a cylinder block 10 having an engine cylinder 10*a* and a cylinder head 10*b* formed integrally with each other. The cylinder block 10 is connected with a crankcase 11 through a heat resistant cylinder gasket 6 by means of bolts 5 to thereby form an engine body EB. The cylinder block 10 and the crankcase 11 are made of, for example, an aluminum alloy by the use of any known casting technique. An ignition plug 20 is mounted a top portion of the cylinder head 10*b*. A plurality of cooling fins 10*d* are integrally formed in an outer periphery of the cylinder head 10*b* by means of the casting technique.

The engine cylinder 10*a* has an intake port 12 fluidly connected with a fuel supply device 14 through an insulator 13 made of a heat resistant resinous material, and an air cleaner 17 is disposed on an upstream side of the fuel supply device 14 with respect to the direction of flow of an air/fuel mixture towards the engine cylinder 10*a* and fluidly connected with the fuel supply device 14. In the embodiment now under discussion, a carburetor is employed for the fuel supply device 14. The insulator 13, the fuel supply device 14 and the air cleaner 17, all referred to above, altogether constitute an intake unit 16. The engine cylinder 10*a* also has an exhaust port 18 fluidly connected with a muffler 19 forming an exhaust unit. A fuel tank 33 is fitted to a lower portion of the crankcase 11.

Figure 3:
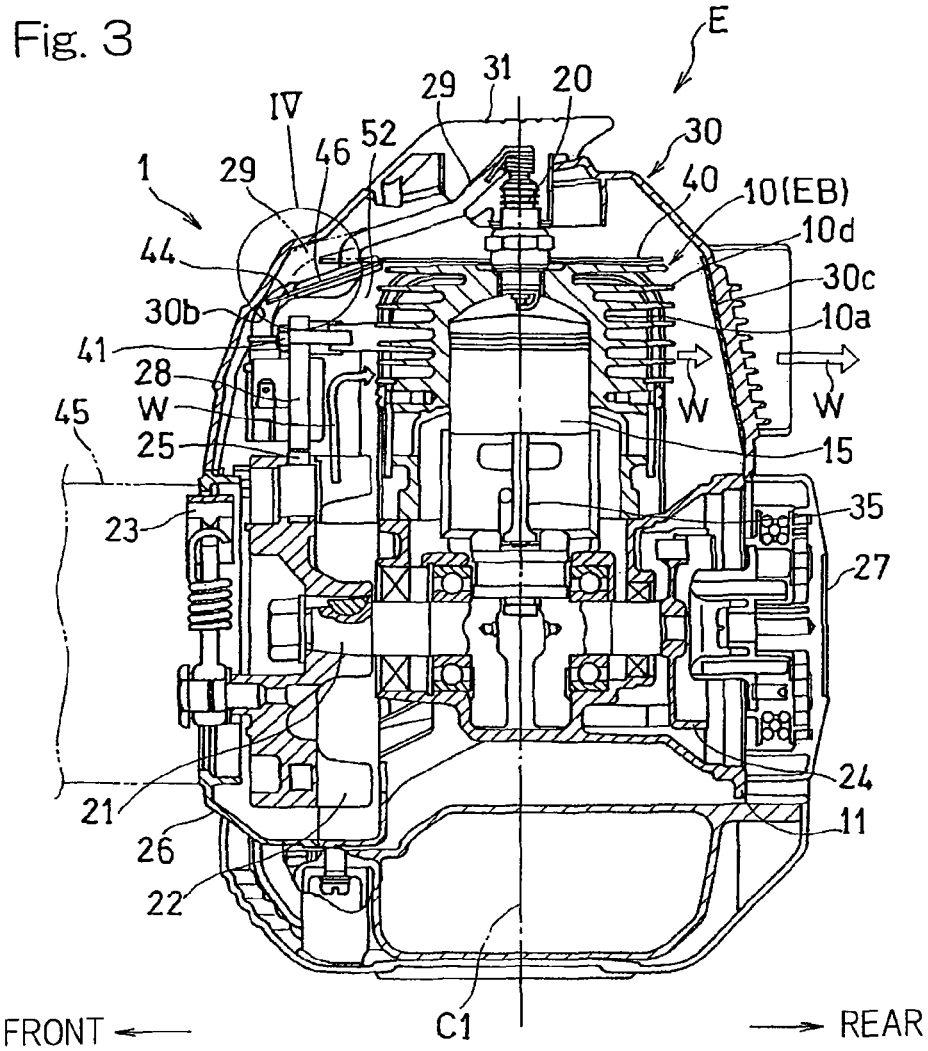
FIG. 3 is a cross sectional view taken along the line III-III in FIG. 2.

Referring to FIG. 3 showing a cross section of the combustion engine E taken along the line in FIG. 2, the engine cylinder 10*a* of the cylinder block 10 has a bore defined therein, and a reciprocating piston 15 is accommodated within such bore in the engine cylinder 10*a* for movement between top and bottom dead center positions in a direction longitudinally of the engine cylinder 10*a*. The reciprocating piston 15 is drivingly connected through a connecting rod 35 with a crankshaft 21 then supported within the crankcase 11. The crankshaft 21 has a front end, on which a cooling fan 21 concurrently serving as a flywheel is mounted for movement together with the crankshaft 21, and a centrifugal clutch 23 for transmitting an output of the combustion engine E to the drive shaft of the brush cutter 1 is fitted outwardly or forwardly of the cooling fan 22. The cooling fan 22 has an outer peripheral portion provided with a magnet 25 mounted thereon.

The cooling fan 22 is enclosed within a fan housing 26 mounted on the crankcase 11, which fan housing 26 is connected with the proximal or rear end of the main pipe 2, best shown in FIG. 1, through a clutch housing 45. The crankshaft 21 also has a rear end opposite to the front end, on which a starter pulley 24 is mounted for rotation together therewith, and a manually operated recoil starter 27 for rotating the crankshaft 21 through the starter pulley 24 at the time of start of the combustion engine E is disposed outwardly or rearwardly of the rear end of the crankshaft 21.

An ignition coil unit 28 is disposed forwardly of the cylinder block 10 and is fixed to the engine body EB by means of fastening members 41 such as, for example, bolts in a manner electrically earthed to the engine body EB. The ignition coil unit 28 has built therein a high voltage generating circuit (not shown) comprised of an ignition coil (also not shown) and cooperates with the built-in ignition coil and the magnet 25, embedded in the cooling fan 22 and rotatable together with such cooling fan 22, to generate a high voltage required to fire the ignition plug 20. For this purpose, the ignition coil unit 28 is electrically connected with the ignition plug 20 through a sheathed ignition cable 29 made up of an electric wire and an electrically insulative sheath enclosing such electric wire.

The ignition coil unit 28, the cylinder block 10 and the muffler 19 best shown in FIG. 2 are enclosed by a shroud 30 made of a resinous material. This shroud 30 is fixed in part to the fan housing 26 and in part to the crankcase 11 by means of set bolts (not shown). On the other hand, as best shown in FIG. 2, the fuel supply device 14 and the air cleaner 17 are enclosed by an air cleaner cap 32 which is a member separate from the shroud 30.

It is, however, to be noted that the shroud 30 may take a structure in which the shroud 30 is divided into a main cover portion for enclosing the cylinder block 10 and a sub cover portion, provided separately from the main cover portion and used to enclose the muffler 19, and those cover portions may be subsequently connected together.

Figure 5:
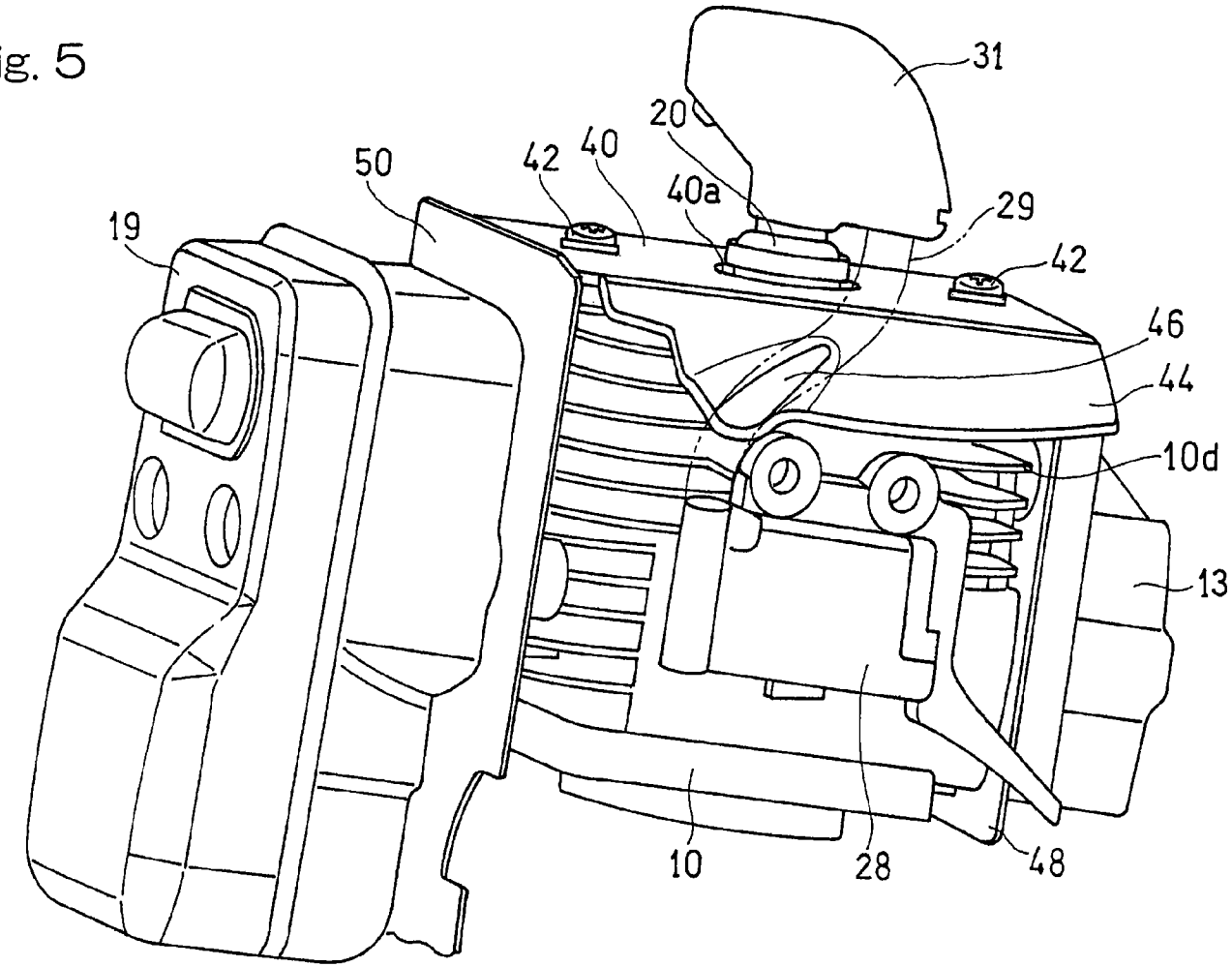
FIG. 5 is a perspective view showing the combustion engine with a shroud removed.

As clearly shown in FIG. 2, the cylinder block 10 has a top portion provided with a top plate 40 lying in a direction perpendicular to the longitudinal axis C1 of the engine cylinder 10*a*. This top plate 40 is prepared from a plate member made of a metal such as, for example, an aluminum alloy and is, as shown in FIG. 5, secured to the top portion of the cylinder block 10 by means of fastening members 42 such as bolts.

It is, however, to be noted that although the illustrated embodiment makes use of the top plate 40 prepared from a plate member made of aluminum, it may not be necessarily limited thereto. Also, although the illustrated embodiment makes use of the top plate 40 and the cylinder block 10, which are members separate from each other, the top plate 40 may be formed integrally with the top portion of the cylinder block 10 in a manner similar to the cooling fins 10*d*.

The top plate 40 has a throughhole 40*a* defined therein and, the ignition plug 20 is, after having been inserted through the throughhole 40*a* in the top plate 40, threaded into a threaded hole 10*c*, defined in the cylinder head 10*b* as shown in FIG. 2, and is hence mounted on the cylinder block 10. A top portion of the ignition plug 20 protrudes outwardly through an insertion hole 30*a*, defined in the shroud 30, and is then enclosed by a plug cap 31 that is removably mounted on the shroud 30.

As best shown in FIG. 3, one of opposite ends of the top plate 40 adjacent the cooling fan 22, i.e., a front end of the top plate 40 is formed with a guide section 44 extending diagonally downwardly therefrom in a direction away from the cylinder block 10 (in a direction forwardly of the engine body EB) for guiding the cooling air W in a direction rearwardly towards the engine cylinder 10. In the illustrated embodiment, the guide section 44 is formed by bending the top plate 40 and is therefore a unitary part of the top plate 40.

As shown in FIG. 5, the guide section 44 of the top plate 40 has a portion generally or substantially intermediate of the width of the guide section 44 depressed downwardly, as viewed in FIG. 3, to define a generally V-shaped guide groove 46 along which the sheathed ignition cable 29 extends. While the sheathed ignition cable 29 is laid in the guide groove 46, the shroud 30 provided with a cable retaining piece 30*b* as best shown in FIG. 3 is mounted on the cylinder block 11 with a portion of the sheathed ignition cable 29 urged against the guide groove 46 by the cable retaining piece 30*b*. By so doing, the ignition cable 29 laid in the guide groove 46 is substantially immovably supported in position.

Figure 4:
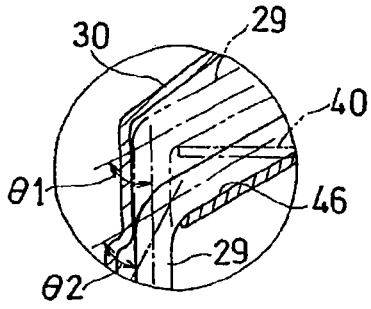
FIG. 4 is a cross sectional view showing on a larger scale a circle IV in FIG. 3.

It is to be noted that unless the guide groove 46 is employed, that portion of the ignition cable 29 needs be bent at a relatively large bending angle θ1 as shown by the double dotted chain line in FIG. 4. In contrast thereto, thanks to the use of the guide groove 46, that portion of the ignition cable 29 can be bent at a relatively small bending angle θ2 and, therefore, an undesirable frictional wear of that portion of the ignition cable 29, which would be brought about by a contact of that portion of the ignition cable 29 with an end edge of the top plate 40, can be advantageously avoided. In addition, in view of that portion of the ignition cable 29 urged by the retaining piece 30*b* against the guide groove 46, the ignition cable 29 and the engine body EB can be electrically connected with each other through the top plate 40.

Figure 6:
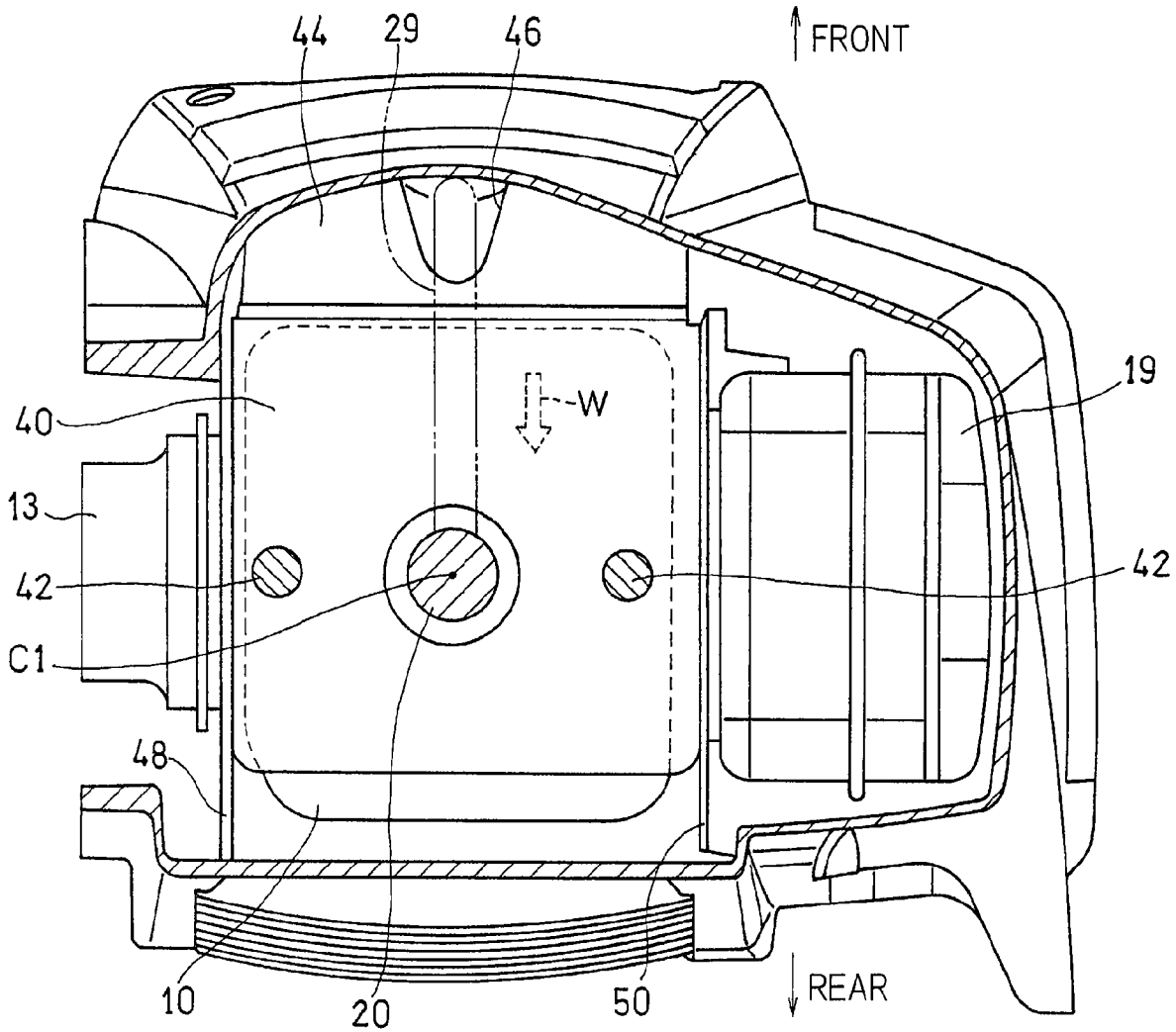
FIG. 6 is a cross sectional view taken along the line VI-VI in FIG. 2.

As can readily be understood from FIG. 6 showing a top plan view, the cylinder block 10, when viewed from top in a direction along the longitudinal axis C1 thereof, is of a generally rectangular shape with the four corner areas rounded substantially, and the top plate 40 similarly represents a generally rectangular shape.

As best shown in FIG. 2, a heat resistant, intake side gasket or seal member 48 is interposed between the engine cylinder 10*a* and the insulator 13 forming a part of the intake unit 16. The intake side gasket 48 is of a type made up of a steel plate coated with a carbon layer or a heat resistant rubber and is fastened to the cylinder block 10 together with the insulator 13 by means of fastening members 49 such as bolts. This intake side gasket 48 has an upper portion held in contact with one end face (left end face, as viewed in FIG. 2) of the top plate 40 and extended to a position above the top plate 40 to thereby seal a gap between the top plate 40 and the intake side gasket 48. On the other hand, the intake side gasket 48 has in its lower end portion an inner surface facing the engine cylinder, which surface is held in contact with the one end face of the cylinder gasket 6 to thereby seal a gap between the intake side gasket 48 and the cylinder gasket 6.

A heat resistant, exhaust side gasket or seal member 50 is interposed between the cylinder block 10 and the muffler 19 forming a part of the exhaust unit. This exhaust side gasket 50 is of a type made up of a steel plate coated with a carbon layer and is fastened to the cylinder block 10 together with the muffler 19 by means of fastening members 51 such as, for example, bolts. The exhaust side gasket 50 has an upper portion held in contact with the opposite end face (right end face, as viewed in FIG. 2) of the top plate 40 and extended to a position above the top plate 40 to thereby seal a gap between the top plate 40 and the exhaust side gasket 50. On the other hand, the exhaust side gasket 50 is extended downwardly to cover up a lower portion of the muffler 19. This exhaust side gasket 50 has an inner surface facing the engine cylinder, which surface is held in contact with the other end face of the cylinder gasket 6 to thereby seal a gap between the exhaust side gasket 50 and the cylinder gasket 6.

The top plate 40 is sandwiched under pressure between the intake and exhaust side gaskets 48 and 50 and are, as best shown in FIG. 6, held in contact with those gaskets 48 and 50 with no gap developed therebetween.

It is, however, to be noted that the manner of contacting the top plate 40 with the gaskets 48 and 50 may not be necessarily limited to that described above. By way of example, the top plate 40 may be formed with slits so that upper ends of the gaskets 48 and 50 may be engaged in such slits. Also, the inner surface (undersurface) of the top plate 40 facing the cylinder block 10 may be held in contact with an upper end face of one or both of the intake side gasket 48 and the exhaust side gasket 50. In this way, a cooling passage 52 for the flow of the cooling air W from the cooling fan 22 shown in FIG. 3 can be formed by the engine cylinder 10*a*, the top plate 40, the intake side gasket 48 and the exhaust side gasket 50. In other words, an outer wall enclosing the cooling passage 52 is formed by the top plate 40, the intake side gasket 48 and the exhaust side gasket 50 and an inner wall of the cooling passage 52 is formed by the cylinder block 10.

Hereinafter, the manner of flow of the cooling air W in the combustion engine E embodying the present invention will be described. Assuming that the combustion engine E is started with the cooling fan 22 driven consequently, a major portion of the cooling air W induced by the cooling fan 22 is guided into the cooling passage 52 by means of the shroud 30, the intake side gasket 48 and the exhaust side gasket 50, shown in FIG. 2. At this time, the ignition coil unit 28 best shown in FIG. 3 is cooled and, after the cylinder block 10 has been cooled by the cooling air W then guided by the guide section 44 so as to flow between the cooling fins 10*d* of the cylinder block 10, the cooling air W, which has been heated as a result of heat exchange, is discharged to the atmosphere through one or more vent holes 30*c* defined in a rear portion of the shroud 30.

With the cooling system so constructed as hereinabove described, the outer wall of the cooling passage 52, along which the cooling air W flows from the cooling fan 22 shown in FIG. 3, is formed by the top plate 40, the intake side gasket 48 and the exhaust side gasket 50, shown in FIG. 2. Further, a gap between the top plate 40 and the intake side gasket 48 and a gap between the top plate 40 and the exhaust side gasket 50 are sealed. In other words, substantially no space exists between the top plate 40 and the intake side gasket 48 nor between the top plate 40 and the exhaust side gasket 50. Accordingly, there is no likelihood that the cooling air W flowing inside the cooling passage 52 will leak. As a result, the cooling air W can be effectively utilized and, hence, the efficiency of cooling the combustion engine E can be increased. Since the intake side and exhaust side gaskets 48 and 50 generally have a heat resistance, there should be no problem even if they contact with the top plate 40 then heated to a high temperature.

Since the top plate 40 best shown in FIG. 5 is formed by bending a metal plate and fastened to the cylinder block 10 by means of the fastening members 42, the structure can be simplified. Also, if the top plate 40 is made to have a function as a heat sink at the time the combustion engine E is halted, the insulator 13 can have a reduced thickness and, consequently, the weight of the combustion engine E as a whole can be reduced advantageously.

Also, since as best shown in FIG. 3 that end of the top plate 40 facing the cooling fan 22 is formed with the guide section 44 so as to extend diagonally downwardly therefrom for guiding the cooling air W towards the cooling passage 52, the cooling air W can be smoothly guided by the guide section 44 and, therefore, the cooling efficiency can be further increased.

Since as best shown in FIG. 5 the guide groove 46 for the ignition cable 29 that connects between the ignition plug 20 and the ignition coil unit 28 is formed in the top plate 40, positioning of that portion of the ignition cable 29 within the guide groove 46 permits the position of the ignition cable 29 to be stabilized. Moreover, since as best shown in FIG. 3, that portion of the ignition cable 29 is bent at a small bending angle θ2 at a location outwardly of the end edge of the top plate 40, an undesirable frictional wear of the outer surface of the ignition cable 29, which would be brought about by its contact with the end edge of the top plate 40, can be suppressed. Also, if the ignition cable 29 is allowed to contact with the top plate 40 made of the metallic material, the noise generating level of the ignition cable 29 can be advantageously suppressed.

Since as best shown in FIG. 2 a gap between the intake side gasket 48 and the cylinder gasket 6 and a gap between the exhaust side gasket 50 and the cylinder gasket 6 are sealed, covering a lower portion of the cooling passage 52, which corresponds to a lower portion of the cylinder block 10, with the cylinder gasket 6 is effective to form the cooling passage 52 completely enclosing opposite side portions of the cylinder block 10, resulting in a yet further increase of the cooling efficiency.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in the previously described embodiment the ignition cable 29 has been shown and described as arranged in the guide groove 46 formed in the top plate 40, the top plate 40 may be formed with a cutout and a grommet may then be mounted in this cutout so that the ignition cable 29 can be supported by this grommet.

Also, although in the previously described embodiment the fuel supply device 14 has been shown and described as comprised of the carburetor, any other fuel supply device such as, for example, a fuel injection system can be employed in the practice of the present invention.

Accordingly, such changes and modifications are, unless they depart from the scope of the present invention as delivered from the claims annexed hereto, to be construed as included therein.

REFERENCE NUMERALS

6 . . . Cylinder gasket
10 . . . Cylinder block
10*a* . . . Engine cylinder
16 . . . Intake unit
19 . . . Muffler (Exhaust unit)
22 . . . Cooling fan
28 . . . Ignition coil unit
29 . . . Ignition cable
40 . . . Top plate
42 . . . Fastening member
44 . . . Guide section
46 . . . Guide groove
48 . . . Intake side gasket
50 . . . Exhaust side gasket
52 . . . Cooling passage
C1 . . . Longitudinal axis of the engine cylinder
E . . . Combustion engine
EB . . . Engine body

What is claimed is:

1. A cooling system for an air cooled combustion engine, which comprises:

a top plate provided on a cylinder block top portion of the combustion engine, provided with a cooling fan, so as to lie perpendicular to a longitudinal axis of an engine cylinder;

an intake side gasket interposed between the cylinder block and an intake unit and extended upwardly to contact the top plate to thereby seal a gap between the top plate and the intake side gasket;

an exhaust side gasket interposed between the cylinder block and an exhaust unit and extended upwardly to contact the top plate to thereby seal a gap between the top plate and the exhaust side gasket; and a cooling passage for passing therethrough a cooling air from the cooling fan, the cooling passage being formed by the cylinder block, the top plate, the intake side gasket and the exhaust side gasket, in which the top plate has an end edge facing the cooling fan and is formed with a guide section so as to extend diagonally downwardly from the end edge of the top plate for guiding the cooling air towards the cooling passage.

2. The cooling system for the air cooled combustion engine as claimed in claim 1, in which the top plate is formed with a guide groove for an ignition cable used to connect between an ignition plug and an ignition coil unit.

3. The cooling system for the air cooled combustion engine as claimed in claim 1, in which each of the intake side gasket and the exhaust side gasket is extended downwardly so as to contact a cylinder gasket, interposed between the cylinder block and a crankcase, to thereby seal a gap between the intake side gasket and the cylinder gasket and a gap between the exhaust side gasket and the cylinder gasket.

4. A combustion engine equipped with the cooling system as defined in claim 1.

5. A brush cutter equipped with the combustion engine as defined in claim 4.

* * * * *